US010424901B2

(12) United States Patent
Isasa et al.

(10) Patent No.: US 10,424,901 B2
(45) Date of Patent: Sep. 24, 2019

(54) SPARK PLUG

(71) Applicant: NGK SPARK PLUG CO., LTD., Nagoya-shi, Aichi (JP)

(72) Inventors: Jumpei Isasa, Iwakura (JP); Seiji Nakano, Kasugai (JP); Hirokazu Kurono, Nagoya (JP); Kuniharu Tanaka, Komaki (JP); Yutaka Yokoyama, Kasugai (JP); Haruki Yoshida, Tajimi (JP); Shun Kondo, Obu (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/095,788

(22) PCT Filed: May 25, 2017

(86) PCT No.: PCT/JP2017/019447
§ 371 (c)(1),
(2) Date: Oct. 23, 2018

(87) PCT Pub. No.: WO2018/003358
PCT Pub. Date: Jan. 4, 2018

(65) Prior Publication Data

US 2019/0131776 A1 May 2, 2019

(30) Foreign Application Priority Data

Jun. 27, 2016 (JP) ..... 2016-126950
Apr. 13, 2017 (JP) ..... 2017-079825

(51) Int. Cl.
*H01T 13/32* (2006.01)
*H01T 13/20* (2006.01)
*H01T 13/06* (2006.01)

(52) U.S. Cl.
CPC ..... *H01T 13/32* (2013.01); *H01T 13/06* (2013.01); *H01T 13/20* (2013.01)

(58) Field of Classification Search
CPC ..... H01T 13/32; H01T 13/06; H01T 13/20; H01T 13/34; H01T 13/39
See application file for complete search history.

(56) References Cited

U.S. PATENT DOCUMENTS 6,548,945 B1 * 4/2003 Tamura ..... H01T 13/08 313/141
2003/0082982 A1 * 5/2003 Nishikawa ..... C03C 3/066 445/7

(Continued)

FOREIGN PATENT DOCUMENTS

JP 2016-004730 A 1/2016

OTHER PUBLICATIONS

International Search Report from corresponding International Patent Application No. PCT/JP17/19447, dated Jun. 20, 2017.

*Primary Examiner* — Anne M Hines
(74) *Attorney, Agent, or Firm* — Kusner & Jaffe

(57) ABSTRACT

Provided is a spark plug capable of ensuring fouling resistance with a simple configuration. An insulator includes a step portion formed on an outer circumferential surface thereof. A center electrode is arranged in an axial hole of the insulator. A cylindrical metal shell having a shelf portion formed on an inner circumferential surface thereof is arranged radially outside the insulator. The insulator further includes a front end portion located frontward of the step portion. An outer circumferential surface of the front end portion has an arithmetic average roughness of 0.5 μm or smaller in a circumferential direction. A recess is formed with a depth of 3 to 20 μm in at least part of an end surface (Continued)

and the outer circumferential surface of the front end portion so as to extend from the front toward the rear.

10 Claims, 7 Drawing Sheets

(56) References Cited

U.S. PATENT DOCUMENTS

| | | | | |
|---|---|---|---|---|
| 2003/0122462 | A1* | 7/2003 | Nishikawa | H01T 13/38 313/143 |
| 2011/0266940 | A1* | 11/2011 | Suzuki | H01T 13/14 313/141 |
| 2012/0262049 | A1* | 10/2012 | Kurono | C04B 35/117 313/141 |
| 2017/0353013 | A1* | 12/2017 | Yoshida | H01T 13/38 |

* cited by examiner

FIG. 2(a)
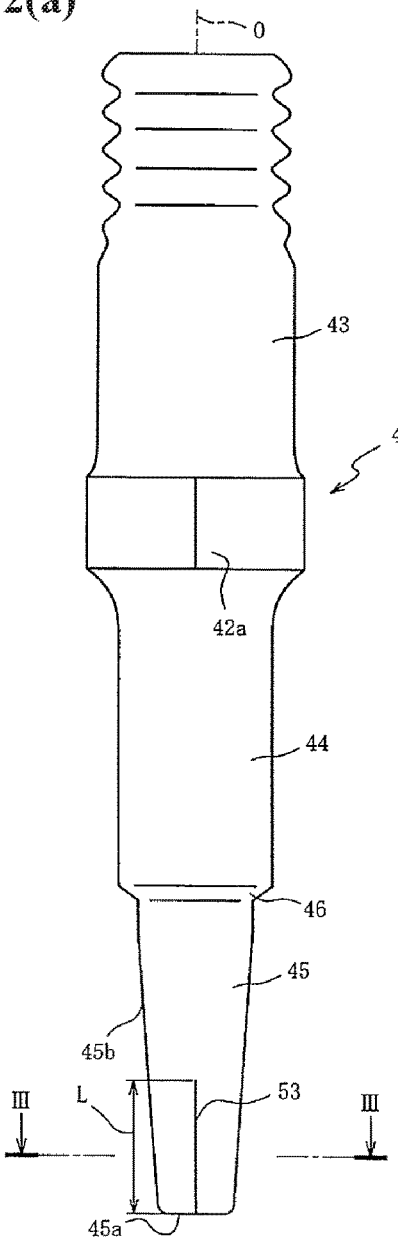
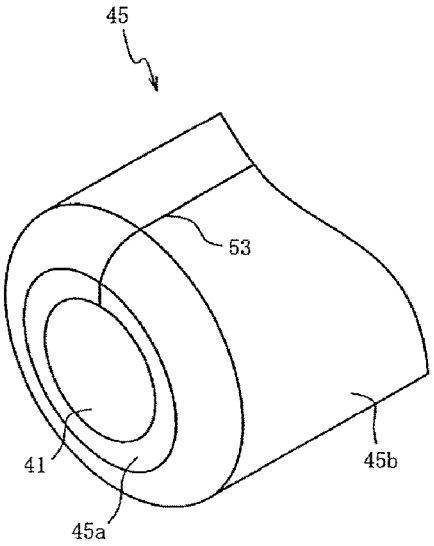
FIG. 2(b)

SPARK PLUG

RELATED APPLICATIONS

This application is a National Stage of International Application No. PCT/JP17/19447 filed May 25, 2017, which claims the benefit of Japanese Patent Application No. 2016-126950, filed Jun. 27, 2016 and Japanese Patent Application No. 2017-079825, filed Apr. 13, 2017, the entire contents of which are incorporated herein by reference.

FIELD OF THE INVENTION

The present invention relates to a spark plug, particularly of the type capable of ensuring fouling resistance.

BACKGROUND OF THE INVENTION

In general, a spark plug has a metal shell, an insulator, a center electrode insulatedly held in the metal shell via the insulator and a ground electrode joined to the metal shell. The spark plug generates a spark discharge between the ground electrode and the center electrode for ignition of an air-fuel mixture in a combustion chamber of an internal combustion engine. However, the spark plug fails to generate a spark discharge when the voltage applied becomes lower than a required voltage (called a spark discharge voltage) with decrease in insulation resistance due to the deposition of carbon on a surface of the insulator by incomplete combustion or the like. There have thus been developed various techniques for preventing fouling of the insulator due to the deposition of carbon.

For example, Japanese Laid-Open Patent Publication No. 2016-4730 discloses a technique in which a protrusion is formed on the insulator so as to protrude in a direction intersecting an axis of the spark plug. In the technique of Japanese Laid-Open Patent Publication No. 2016-4730, a carbon deposit on the protrusion provides a conductive path between the center electrode and the metal shell so that a discharge occurs in an air gap along the conductive path. By this discharge, carbon deposited on the insulator is burned away.

Against the above technical background, there has been a demand to ensure the fouling resistance of the spark plug with a simpler configuration.

The present invention has been made to satisfy such a demand. An advantage of the present invention is a spark plug capable of attaining fouling resistance with a simple configuration.

In accordance with a first aspect of the present invention, there is provided a spark plug comprising: a center electrode extending along an axis from front to rear; a cylindrical insulator having formed therein along the axis an axial hole in which the center electrode is arranged, the insulator including a step portion formed on an outer circumferential surface thereof and having a diameter increasing from a front end side to a rear end side; a cylindrical metal shell arranged radially outside the insulator, the metal shell including a shelf portion formed on an inner circumferential surface thereof and facing the step portion in a direction of the axis; and a ground electrode joined to the metal shell and facing the center electrode, wherein the insulator includes a front end portion located frontward of the step portion; wherein an outer circumferential surface of the front end portion has an arithmetic average roughness of 0.5 μm or smaller in a circumferential direction; and wherein a recess is formed with a depth of 3 to 20 μm in at least part of an end surface and the outer circumferential surface of the front end portion so as to extend from the front toward the rear.

In a spark plug according to the first aspect of the invention, the outer circumferential surface of the front end portion of the insulator, which is located frontward of the step portion of the insulator, has an arithmetic average roughness of 0.5 μm or smaller in the circumferential direction; and the recess is formed with a depth of 3 to 20 μm in at least part of the end surface and outer circumferential surface of the front end portion. With this structure, carbon is unlikely to be deposited onto the end surface and outer circumferential surface of the front end portion but is easily deposited in the recess. As the carbon deposited in the recess provides a conductive path, a discharge is generated along the conductive path so that carbon deposits on the insulator can be burned away by the discharge. Therefore, the spark plug ensures the fouling resistance of the insulator with a simple configuration.

In accordance with a second aspect of the present invention, there is provided a spark plug as described above, wherein the depth of the recess is 5 to 10 μm. In this case, it is possible to more easily cause deposition of carbon in the recess while ensuring the strength of the front end portion of the insulator. The spark plug thus achieves improved fouling resistance in addition to the effects of the first aspect of the invention.

In accordance with a third aspect of the present invention, there is provided a spark plug as described above, wherein a width of the recess in the circumferential direction is 3 to 200 μm. In this case, it is possible to more easily cause deposition of carbon in the recess. The spark plug thus achieves improved fouling resistance in addition to the effects described above with respect to the first and second aspects of the invention.

In accordance with a fourth aspect of the present invention, there is provided a spark plug as described above, wherein a length of the recess in the direction of the axis is 0.1 to 20 mm. In this case, it is possible to easily provide the conductive path for burning away of carbon deposits. The spark plug thus achieves improved fouling resistance in addition to the effects described above with respect to the first through third aspects of the invention.

In accordance with a fifth aspect of the present invention, there is provided a spark plug as described above, wherein two to eight recesses are formed in the front end portion at positions apart from each other in the circumferential direction. In this case, there are provided a plurality of conductive paths by deposition of carbon in the two to eight recesses so that it is possible to easily generate a discharge for burning away of carbon deposits. The spark plug thus achieves improved fouling resistance in addition to the effects described above with respect to the first through fourth aspects of the invention.

In accordance with a sixth aspect of the present invention, there is provided a spark plug as described above, wherein the recesses are equally spaced apart from each other in the circumferential direction. In this case, the recesses are arranged in all directions in a state that the spark plug is mounted to an internal combustion engine. The spark plug thus prevents variations in fouling resistance depending on the orientation of the insulator on the internal combustion engine, in addition to achieving the effect of the fifth aspect of the invention.

In accordance with a seventh aspect of the present invention, there is provided a spark plug as described above, wherein assuming, in a cross section perpendicular to the axis, a first imaginary straight line passing through the axis and a second imaginary straight line passing through the axis and intersecting the first imaginary line at a right angle, a first region of the front end portion overlapping the first imaginary straight line is greater in length than a second region of the front end portion overlapping the second imaginary straight line; and the recess is located on the front end portion within the range of ±15° from the first region. In this case, it is possible to secure the thickness of the part of the front end portion in which the recess is formed and suppress the influence of the recess on the strength and insulating properties of the front end portion. Thus, the spark plug ensures the strength and insulating properties of the front end portion in addition to achieving the effects described above with respect to the first through sixth aspects of the invention.

In accordance with an eighth aspect of the present invention, there is provided a spark plug as described above, wherein a value of the length of the second region being divided by the length of the first region is in a range of 0.7 to 0.96. In this case, the spark plug ensures withstand voltage and prevents penetration breakage of the front end portion caused starting from the recess by the applied voltage, in addition to achieving the effects of the seventh aspect of the invention.

In accordance with a ninth aspect of the present invention, there is provided a spark plug as described above, wherein the recess is located at a side opposite from the ground electrode with the center electrode interposed therebetween when viewed in the direction of the axis. As compared to the ground electrode-side, there is a wide space for the growth of a flame kernel on the side opposite from the ground electrode so that a large flame can be developed for burning away of the carbon deposited in the recess. As it is possible to burn away carbon deposits over a wide area on the front end portion, the spark plug achieves improved fouling resistance in addition to the effects described above with respect to the first through eighth aspects of the invention.

In accordance with a tenth aspect of the present invention, there is provided a spark plug as described above, wherein the insulator includes a protruding portion protruding radially outwardly from the outer circumferential surface thereof at a position rearward of the step portion; the metal shell has an engaged part formed on the outer circumferential surface thereof at a position rearward of the shelf portion; and the protruding portion has an engaging part that engages with the engaged part in the circumferential direction. The recess of the insulator is positioned relative to the metal shell by circumferential engagement of the engaging part with the engaged part. Thus, the spark plug achieves easy positioning of the recess relative to the metal shell in addition to the effects described above with respect to the first through ninth aspects of the invention.

BRIEF DESCRIPTION OF THE DRAWINGS

FIG. 2(*a*) is a side view of an insulator of the spark plug; and FIG. 2(*b*) is a cross-sectional view of a front end portion of the insulator.

DETAILED DESCRIPTION OF THE INVENTION

Hereinafter, preferred embodiments of the present invention will be described blow with reference to the drawings.

Figure 1:
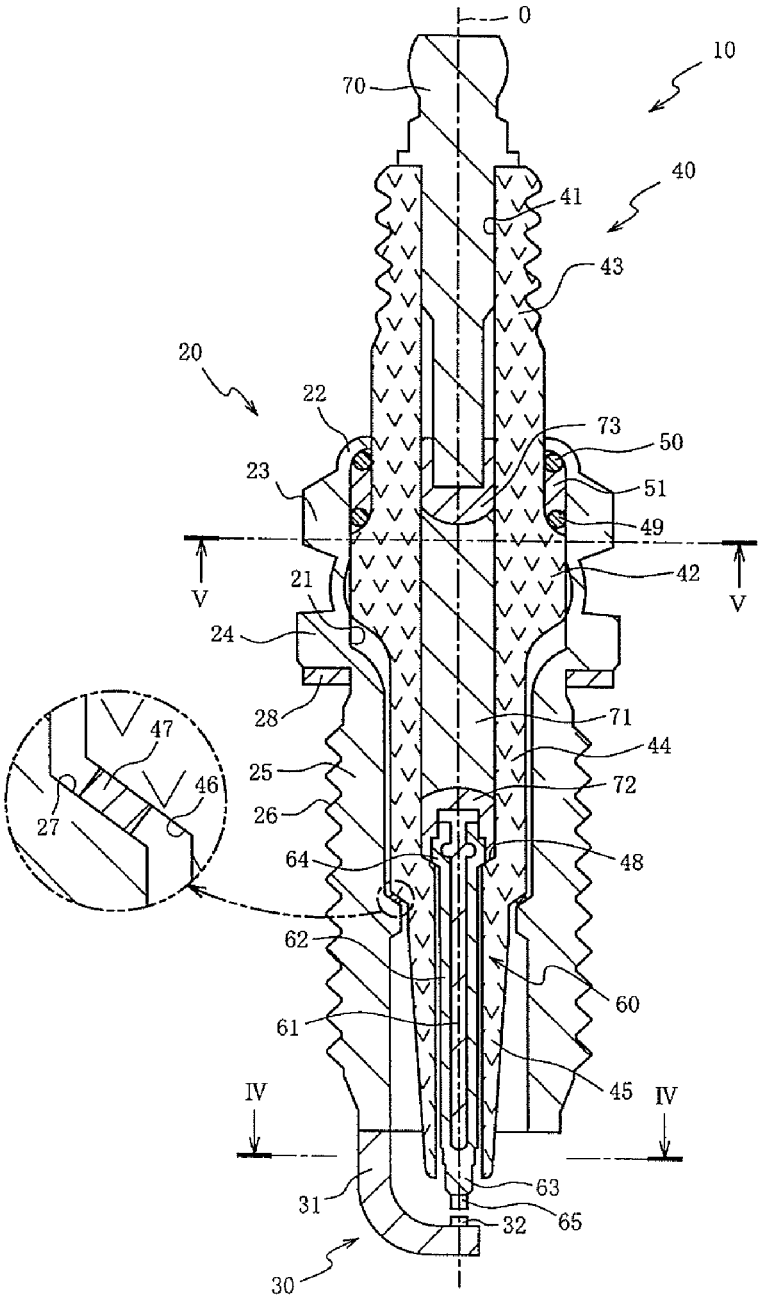
FIG. 1 is a cross-sectional view of a spark plug according to a first embodiment of the present invention.

FIG. 1 is a cross-sectional view of a spark plug 10, taken along a plane including an axis O of the spark plug 10, according to the first embodiment of the present invention. Herein, the lower and upper sides in FIG. 1 are respectively referred to as front and rear sides of the spark plug 10. As shown in FIG. 1, the spark plug 10 is provided with a metal shell 20, a ground electrode 30, an insulator 40 and a center electrode 60.

The metal shell 20 is substantially cylindrical-shaped so as to be fixed in a screw hole (not shown) of an internal combustion engine. A through hole 21 is formed through the metal shell 20 along the axis O. The metal shell 20 is made of a conductive metal material (such as low carbon steel), and includes a crimp portion 22, a tool engagement portion 23, a seat portion 24 and a body portion 25 arranged in this order from the front to the rear along the direction of the axis O. A thread 26 is formed on an outer circumferential surface of the body portion 25 for screw fitting in the screw hole of the internal combustion engine.

The crimp portion 22 is crimped onto the insulator 40. The tool engagement portion 23 is formed such that a tool such as wrench for screwing the thread 26 in the screw hole (not shown) of the internal combustion engine can be engaged on the tool engagement portion 23. The seat portion 24 is formed to press a gasket 28 which is fitted between the seat portion 24 and the body portion 25. The gasket 28 is held between the seat portion 24 and the internal combustion engine so as to seal a clearance between the tread 26 and the screw hole. Further, the metal shell 20 includes a radially inwardly protruding shelf portion 27 formed on an inner circumferential side of the body portion 25. The shelf portion 27 has a diameter decreasing from the rear end side toward the front end side.

The ground electrode 30 has: an electrode base 31 made of a metal material (e.g. nickel-based alloy) and joined to a front end of the metal shell 20 (more specifically, an end surface of the body portion 25); and a tip 32 joined to a distal end portion of the electrode base 31. The electrode base 31 is rod-shaped and bent toward the axis O so as to intersect the axis O. The tip 32 is made of a noble metal e.g. platinum, iridium, ruthenium, rhodium etc. or an alloy containing such a noble metal as a main component and is joined to the electrode base 31 at a position intersecting the axis O.

The insulator 40 is substantially cylindrical-shaped and made of e.g. alumina having good mechanical properties and high-temperature insulating properties. An axial hole 41 is formed through the insulator 40 along the axis O. The insulator 40 includes a protruding portion 42 formed with a maximum outer diameter at an axially middle position thereof, a rear body portion 43 located rearward of the protruding portion 42, a middle body portion 44 and a front end portion 45 each located frontward of the protruding portion 42.

The front end portion 45 is formed in a cylindrical shape having an outer diameter smaller than that of the middle body portion 44. The insulator 40 also includes a step portion 46 formed between the middle body portion 44 and the front end portion 45 such that the step portion 46 has a diameter decreasing from the middle body portion 44 toward the front end portion 45. A packing 47 is disposed between the step portion 46 and the shelf portion 27 of the metal shell 20. The packing 47 is made of a metal material such as soft steel plate softer than that of the metal material of the metal shell 20.

In the insulator 40, a radially inwardly protruding receiving part 48 is formed on an inner circumferential surface of the middle body portion 44. The receiving part 48 has a diameter decreasing from the rear end side toward the front end side. The insulator 40 is inserted in the though hole 21 of the metal shell 20, so that the metal shell 20 is fixed on an outer circumference of the insulator 40 with a front end of the front end portion 45 and a rear end of the rear body portion 43 being exposed outside from the through hole 21 of the metal shell 20.

Ring members 49 and 50 are disposed between the crimp and tool engagement portions 22 and 23 of the metal shell 20 and the rear body portion 43 of the insulator 40. A filling material 51 such as talc is filled in a space between the ring members 49 and 50. When the crimp portion 22 is crimped, the insulator 40 is pushed in the direction of the axis O through the ring members 49 and 50 and the filling material 51. As a consequence, the packing 47 disposed between the shelf portion 27 of the metal shell 20 and the step portion 46 of the insulator 40 is deformed and brought into intimate contact with the shelf portion 27 and the step portion 46.

The center electrode 60 is rod-shaped, having: a bottomed cylindrical-shaped electrode base; and a core 61 having a thermal conductivity higher than that of the electrode base and embedded in the electrode base. The core 61 is made of copper or an alloy containing copper as a main component. The center electrode 60 includes a shaft portion 62 extending toward the front within the axial hole 41 along the axis O, a small-diameter portion 63 formed adjacently on a front end of the shaft portion 62 and a head portion 64 formed on a rear end side of the shaft portion 62 and received on the receiving part 48 of the insulator 40 (middle body portion 44).

The small-diameter portion 63 has an outer diameter smaller than that of the shaft portion 62. A boundary part between the small-diameter portion 63 and the shaft portion 62 is formed in a stepwise shape. This stepwise boundary is located within the axial hole 41. A front end of the small-diameter portion 63 protrudes from the axial hole 41. A tip 65 is joined to the front end of the small-diameter portion 63. The tip 65 is made of a noble metal e.g. platinum, iridium, ruthenium, rhodium etc. or an alloy containing such a noble metal as a main component in a column shape.

A metal terminal 70 is made of a conductive metal material (e.g. low carbon steel) in a rod shape for connection to a high voltage cable (not shown). A front end portion of the metal terminal 70 is disposed in the axial hole 41 of the insulator 40. A resistor 71 is disposed between the metal terminal 70 and the center electrode 60 within the axial hole 41 so as to suppress a radio noise caused by a spark discharge. The resistor 71 is electrically connected at respective ends thereof to the center electrode 60 and the metal terminal 70 via conductive glass seals 72 and 73, each of which is made of a glass material containing a metal powder.

The insulator 40 will be explained in more detail below with reference to FIG. 2. FIG. 2(*a*) is a side view of the insulator 40; and FIG. 2(*b*) is a perspective view of the front end portion 45 of the insulator 40. As shown in FIG. 2(*a*), the rear body portion 43, the protruding portion 42, the middle body portion 44, the step portion 46 and the front end portion 45 of the insulator 40 are arranged contiguously from the rear end side to the front end side along the axis O. An engaging part 42*a* (explained later) is formed on an outer circumferential surface of the protruding portion 42.

An outer circumferential surface 45*b* of the front end portion 45 has an arithmetic average roughness Ra of 0.5 μm or smaller in a circumferential direction. The arithmetic average roughness Ra is determined according to JIS B 0601 (1994). The determination of the arithmetic average roughness Ra can be made with the use of a non-contact type profile-measuring laser microscope VK-X100/X100 (available from Keyence Corporation), a microscope such as SEM and an image analysis software WinROOF (available from Mitani Corporation) for analysis of an image obtained by the microscope.

A recess 53 is formed in the outer circumferential surface 45*b* of the front end portion 45 (more specifically, a part of the outer circumferential surface 45*b* that can be visually identified in side view from a direction perpendicular to the axis O). The recess 53 extends from the front toward the rear. The recess 53 is in the form of an elongated depression having a length L greater than a width W thereof. In the present first embodiment, the recess 53 is continuous from the outer circumferential surface 45*b* to an end surface 45*a* of the front end portion 45 as shown in FIG. 2(*b*). Furthermore, one recess 53 is provided in the front end portion 45 in the present first embodiment. Herein, the end surface 45*a* of the front end portion 45 also has an arithmetic average roughness Ra of 0.5 μm or smaller.

The insulator 40 in which the outer circumferential surface 45*b* of the front end portion 45 has a circumferential arithmetic average roughness Ra of 0.5 μm or smaller can be produced by injection molding the insulator material and firing the molded body. The injection molding is performed using a mold (not shown) with a protrusion so that the recess 53 is formed in the front end portion 45 in correspondence with the protrusion. It is feasible to freely set the position and size etc. of the recess 53 according to the position and size etc. of the protrusion.

The recess 53 is formed by sintering the recessed part of the molded body rather than formed by processing or breaking the fired body. Accordingly, the surface texture of the recess 53 observed by SEM or the like is the same as that of any part of the outer circumferential surface 45*b* other than the recess 53.

Figure 3:
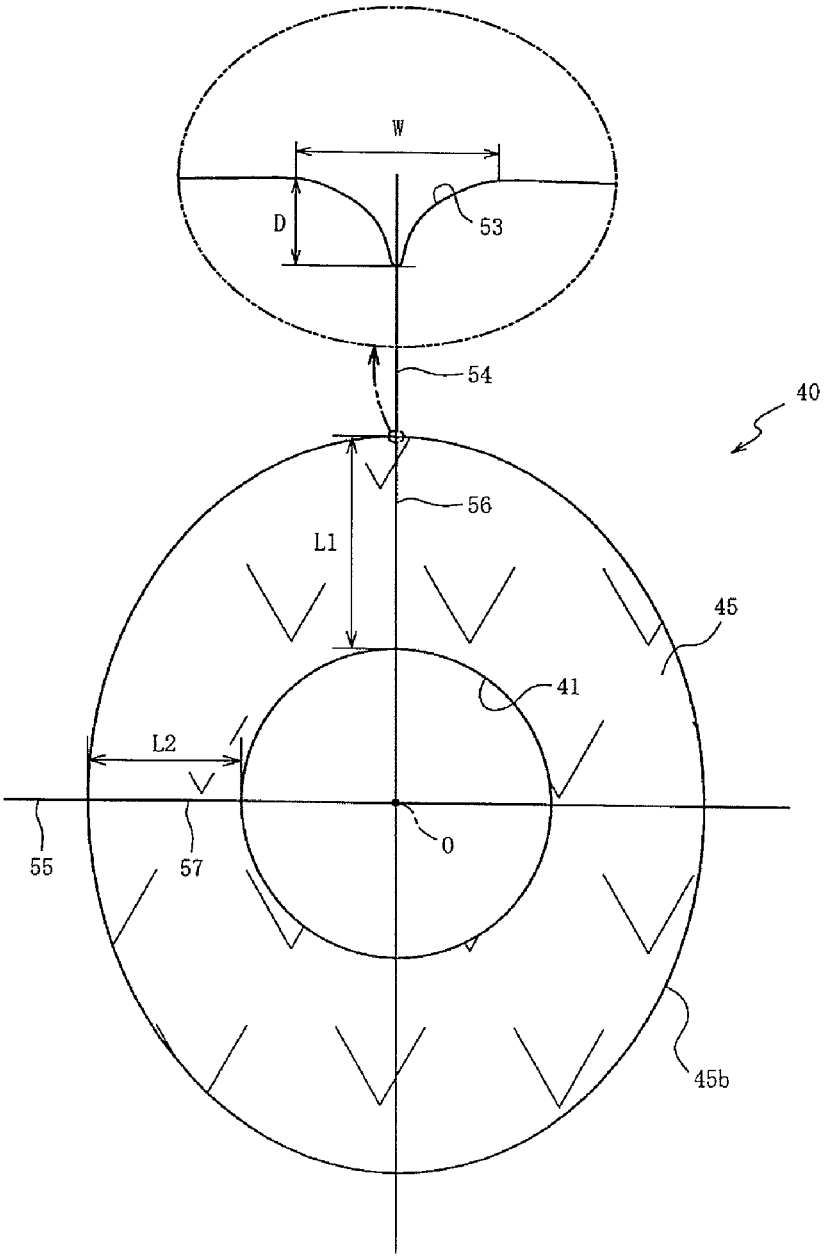
FIG. 3 is a cross-sectional view of the front end portion of the insulator as taken along line III-III of FIG. 2(*a*).

FIG. 3 is a cross-sectional view of the front end portion 45 taken along line III-III of FIG. 2(*a*). When viewed in cross section perpendicular to the axis O, the front end portion 45 is oval in outer shape; and the axial hole 41 is circular in shape as shown in FIG. 3. In the cross section, a first imaginary straight line 54 is defined as a straight line passing through the axis O; and a second imaginary straight line 55 is defined as a straight line passing through the axis O and intersecting the first imaginary straight line 54 at a right angle. In the present first embodiment, the first imaginary straight line 54 overlaps a longer axis of the oval outer shape of the front end portion 45; and the second imaginary straight line 55 overlaps a shorter axis of the oval outer shape of the front end portion 45. The positions of the first and second imaginary straight lines 54 and 55 are however not limited to these positions and can be set as appropriate within the range that satisfies L1>L2 (explained later).

A length L1 of a first region 56 of the front end portion 45 overlapping the first imaginary straight line 54 is greater than a length L2 of a second region 57 of the front end portion 45 overlapping the second imaginary straight line 55. Among the outer circumferential surface 45*b* of the front end portion 45, the recess 53 is located within the range of ±15° from the first region 56. In the present first embodiment, the recess 53 is provided at point of intersection of the first imaginary straight line 54 and the outer circumferential surface 45*b*.

A depth D of the recess 53 from the outer circumferential surface 45*b* is set greater than or equal to 3 μm and smaller than or equal to 30 μm. The width W of the recess 53 is preferably set to 3 μm to 200 μm. Further, the length L of the recess 53 in the direction of the axis O on the outer circumferential surface 45*b* (including the end surface 45*a*) (see FIG. 2(*a*)) is preferably set to within the range of 0.1 mm to 20 mm. The width W, depth D and length of the recess 53 can be determined with the use of a non-contact type profile-measuring laser microscope VK-X100/X100 (available from Keyence Corporation).

In a state that the spark plug 10 is mounted to the internal combustion engine (not shown), at least a part of the front end portion 45 (more specifically, the end surface 45*a* and a front end part of the outer circumferential surface 45*b*) is exposed inside the combustion chamber. As the outer circumferential surface 45*b* (except the recess 53) of the front end portion 45 has a circumferential arithmetic average roughness Ra of 0.5 μm or smaller, carbon generated by incomplete combustion or the like is unlikely to be deposited onto the outer circumferential surface 45*b* and the end surface 45*a*. On the other hand, carbon is easily deposited in the recess 53. A discharge is generated along a conductive path defined by the carbon deposited in the recess 53 so as to burn away the carbon deposited in the recess 53 and in the vicinity of the recess 53 on the front end portion 45.

In the present first embodiment, the small-diameter portion 63 is formed stepwisely on the front end of the shaft portion 62 of the center electrode 60 (see FIG. 1) so that there is an air gap left between the axial hole 41 of the front end portion 45 and the small-diameter portion 63. With the utilization of such an air gap, a discharge is generated between the stepwise edge between the shaft portion 62 and the small-diameter portion 63 and the carbon deposited in the recess 53 (conductive path) so that the carbon deposited in the recess 53 can be burned away by the discharge and so that the carbon deposited in the vicinity of the recess 53 can be burned away by a flame resulting from the discharge.

As the recess 53 is continuous from the outer circumferential surface 45*b* to the end surface 45*a* of the front end portion 45, the conductive path is defined by the carbon deposited in the recess 53 from the outer circumferential surface 45*b* to the end surface 45*a* of the front end portion 45. In this configuration, the conductive path tends to exist in the end surface 45*a* of the front end portion 45 so as to easily generate a discharge by means of the small-diameter portion 63 of the center electrode 60 (see FIG. 1). The recess 53 is not however necessarily formed in the end surface 45*a*.

When the depth D of the recess 53 is smaller than 3 μm, it tends to be difficult for the carbon entering into the recess 53 to remain in the recess 53. When the depth D of the recess 53 exceeds 20 μm, the recess 53 may serve as a starting point of penetration breakdown of the front end portion 45 by the applied voltage. When the depth D of the recess 53 is in the range of 3 μm to 20 μm, it is possible to easily cause deposition of carbon in the recess 53 while ensuring the strength of the front end portion 45.

When the width W of the recess 53 is smaller than 3 μm, it tends to be difficult to allow entry of the carbon into the recess 53. When the width W of the recess 53 exceeds 200 μm, it tends to be difficult for the carbon entering into the recess 53 to remain in the recess 53. When the width W of the recess 53 is in the range of 3 μm to 200 μm, it is possible to easily cause entry and deposition of the carbon in the recess 53.

When the length L of the recess 53 is smaller than 0.1 mm, the conductive path defined by the carbon deposited in the recess is short. As a result, it tends to be difficult to generate a discharge along the conductive path defined by the deposited carbon. Even when the length L of the recess 53 is increased over 20 mm, the amount of the carbon entering into the rear end side of the recess 53 is smaller than the amount of the carbon entering into the front end side of the recess 53 so that there is almost no change in the total amount of the carbon deposited in the recess 53. When the length L of the recess 53 is in the range of 0.1 mm to 20 mm, it is possible to easily define the conductive path which contributes to a discharge.

It is herein conceivable to form the recess 53 only in the end surface 45*a*, only in the outer circumferential surface 45*b*, or from the end surface 45*a* to the outer circumferential surface 45*b*. Regardless of in which part of the front end portion 45 the recess 53 is formed, the length L of the recess 53 refers to the total length of the recess 53 (with a depth of 3 to 20 μm).

As the recess 53 is formed in the outer circumferential surface 45*b* of the front end portion 45 within the range of ±15° from the first region 56, the length of the part of the front end portion 45 in which the recess 53 can be secured so as to suppress the influence of the recess 53 on the strength and insulating properties of the front end portion 45. It is thus possible to ensure the strength and insulating properties of the front end portion 45.

Preferably, the value L2/L1 obtained by dividing the length L2 of the second region 57 by the length L1 of the first region 56 is in the range of 0.7 to 0.96. When $L2/L1<0.7$, the length L2 of the second region 57 (i.e. the wall thickness of the second region 57) is small so that the withstand voltage of the second region 57 tends to be lowered. When $L2/L1>0.96$, penetration breakdown of the front end portion 45 may be caused starting from the recess 53 by the applied voltage depending on the thickness of the front end portion 45. When $0.7<L2/L1<0.96$, it is possible to ensure the withstand voltage of the front end portion 45 and prevent penetration breakdown of the front end portion 45 caused starting from the recess 53 by the applied voltage.

Figure 4:
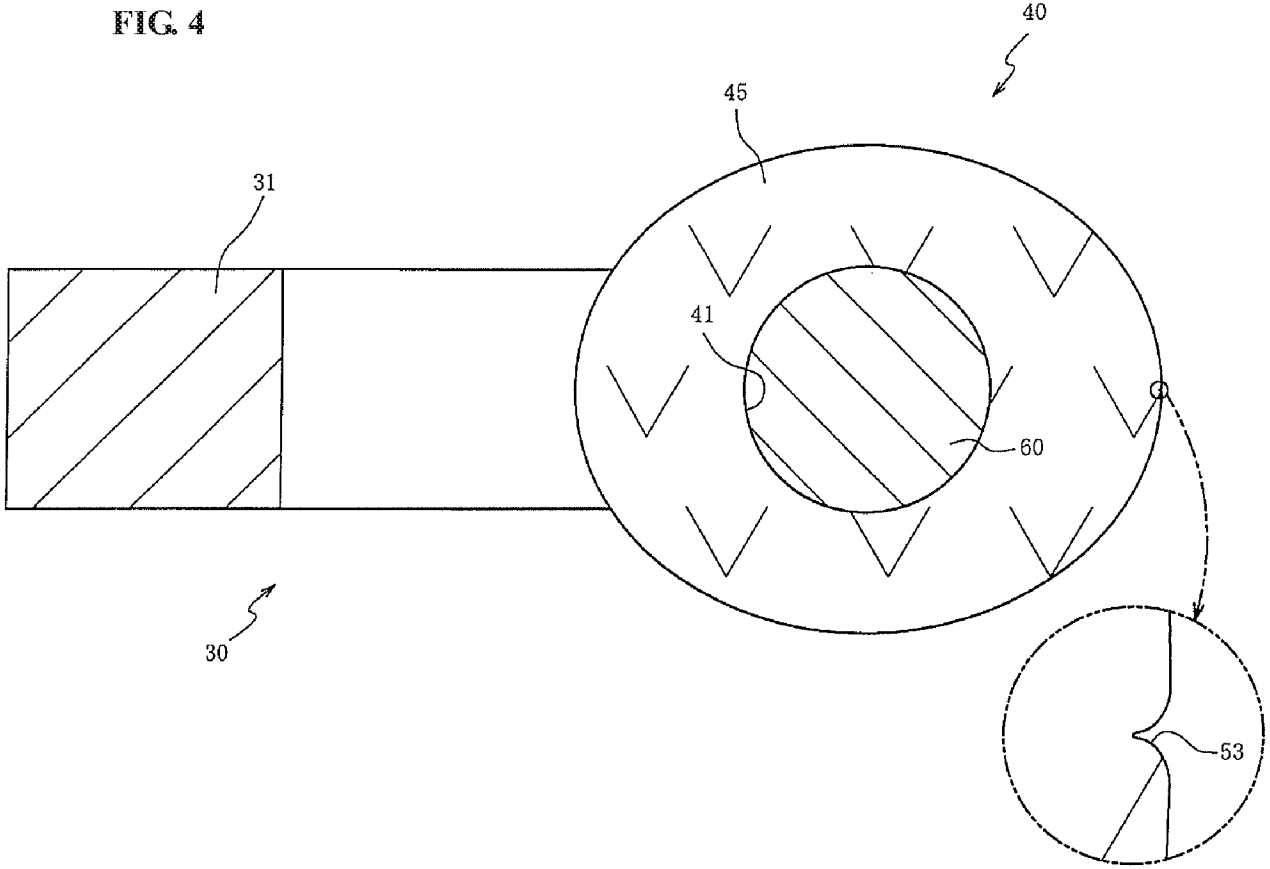
FIG. 4 is a cross-sectional view of the spark plug as taken along line IV-IV of FIG. 1.

FIG. 4 is a cross-sectional view of the spark plug 10 taken along line IV-IV of FIG. 1. In FIG. 4, the core 61 embedded in the center electrode 60 (shaft portion 62) is omitted from illustration for simplification purposes. When viewed in the direction of the axis, the recess 53 is located at a side opposite from the ground electrode 30 (electrode base 31) with the center electrode 60 interposed therebetween as shown in FIG. 4.

The space for the growth of a flame kernel is widened, by an amount in which the ground electrode 30 is not present, on the side opposite from the ground electrode 30 beyond the center electrode 60 (i.e. the right side in FIG. 4) as compared to the ground electrode 30 side (i.e. the left side in FIG. 4). Consequently, a large flame can be developed for burning away of the carbon deposited in the recess 53 as compared to the case where the recess 53 is located at the ground electrode 30 side. By such a flame, it is possible to burn away carbon deposits over a wide area on the front end portion 45 and improve the fouling resistance of the spark plug 10.

Figure 5:
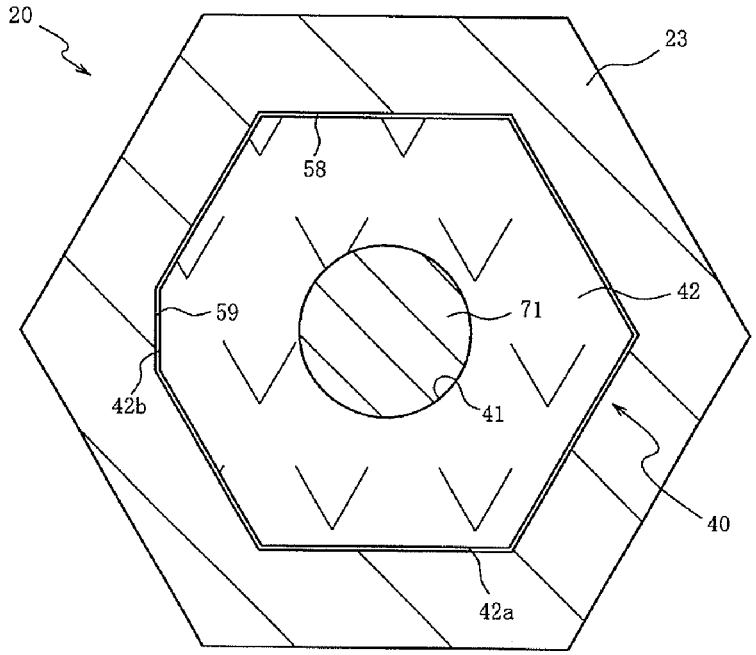
FIG. 5 is a cross-sectional view of the spark plug as taken along line V-V of FIG. 1.

In order to form the recess 53 in the part of the insulator 40 opposite from the ground electrode 30, it is necessary to accurately assemble the metal shell 20 to which the ground electrode 30 has previously been joined onto the insulator 40. The relationship of the metal shell 20 and the insulator 40 will be now explained below with reference to FIG. 5. FIG. 5 is a cross-sectional view of the spark plug 10 taken along line V-V of FIG. 1.

In the insulator 40, the engaging part 42*a* is formed on the outer circumferential surface of the protruding portion 42 so as to circumferentially engage with an engaged part 58 (explained later) of the metal shell 20. In the present first embodiment, the protruding portion 42 is polygonal column-shaped such that an outer shape of the protruding portion 42 is substantially regular hexagonal (polygonal) when viewed in the direction of the axis; the engaging part 42*a* is constituted by ridges and faces adjacent thereto of the polygonal column shape.

A mark 42*b* is formed on the outer circumferential surface of the protruding portion 42 for positioning of the protruding portion 42 in the circumferential direction. In the present first embodiment, the mark 42*b* is in the form of a chamfered corner on one ridge of the polygonal protruding portion. When viewed in the direction of the axis, the mark 42*b* is located at a side opposite from the recess 53 with the axial hole 41 interposed therebetween. As the insulator 40 is produced by injection molding, the engaging part 42*a* and the mark 42*b* can be easily formed by the design of the injection mold (not shown).

The engaged part 58 is formed on the inner circumferential surface of the metal shell 20. In the present first embodiment, the engaged part 58 is formed on the inner circumference of the tool engagement portion 23. The engaged part 58 has a substantially regular hexagonal (polygonal) tubular shape slightly larger than the protruding portion 42 of the insulator 40 such that the protruding portion 42 can be inserted in the engaged part 58. The engaged part 58 is constituted by ridges and adjacent faces thereto of the polygonal shape. The outer shape of the tool engagement portion 23 is regular hexagonal, similar to the shape of the engaged part 58.

A mark 59 is formed on one ridge of the engaged part 58 for positioning of the insulator 40 in the circumferential direction. The mark 59 is provided corresponding to the mark 42*b* on the protruding portion 42 of the insulator 40, with a part of the through hole 21 (see FIG. 1) projecting radially inwardly. In the present first embodiment, the mark 59 is located on an extension of the position of joining of the electrode base 31 of the ground electrode 30 to the metal shell 20 in the direction of the axis O. As the metal shell 20 is produced by cold forging or the like, the polygonal engaged part 58 can be relatively easily formed.

As mentioned above, the marks 42*b* and 59 are respectively formed on the metal shell 20 and the insulator 40. By inserting the insulator 40 into the metal shell 20 while bringing these marks 42*b* and 59 into alignment with each other, the insulator 40 is placed in position such that the recess 53 is located at the side opposite from the ground electrode 30 (electrode base 31) with the center electrode 60 interposed therebetween as viewed in the direction of the axis. The engaged part 58 is formed such that, unless the marks 42*b* and 59 are in alignment with each other, the protruding portion 42 cannot be inserted in the metal shell 20. This prevents an error in the assembling position of the insulator 40 relative to the metal shell 20.

As the engaging part 42*a* is formed on the protruding portion 42, the recess 53 of the insulator 40 is placed in position relative to the metal shell 30 by circumferential engagement of the engaging part 42*a* with the engaged part 58 of the metal shell 20. This facilitates the positioning of the recess 53 relative to the metal shell 20.

Figure 6:
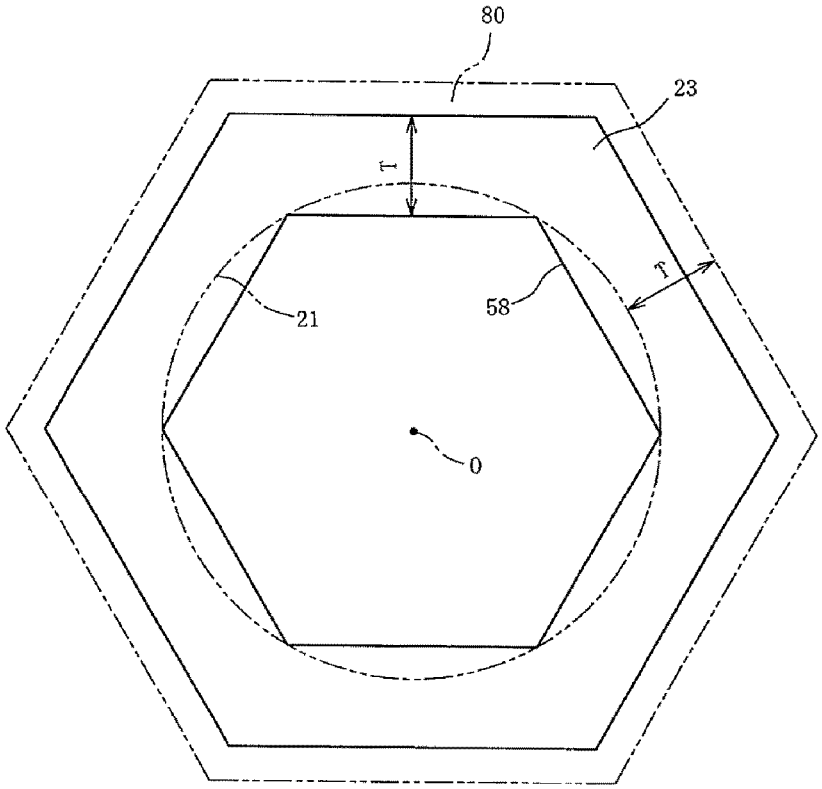
FIG. 6 is a cross-sectional view of a tool engagement portion of a metal shell of the spark plug.

Furthermore, the tool engagement portion 23 is similar in outer shape to the engaged part 58 as mentioned above. This enables a reduction in the outer shape of the tool engagement portion 23 as compared to a conventional metal shell with no engaged part. The outer size reduction of the tool engagement part will be explained in detail below with reference to FIG. 6. FIG. 6 is a cross-sectional view of the tool engagement portion 23. In FIG. 6, a cross section of the tool engagement portion 23 taken perpendicular to the axis O is indicated by a solid line; and a cross section of a conventional tool engagement portion 80 is shown by a double-dot chain line.

The conventional tool engagement portion 80 is formed with a circular cross-section through hole 21. To ensure the strength of the tool engagement portion 80, the tool engagement portion 80 is formed into a regular hexagonal outer shape with a predetermined dimension (thickness T) left outside the circular through hole 21.

In the present first embodiment, the engaged part 58 (except the mark 59) has a regular hexagonal outer shape inscribed in the through hole 21. As is apparent from FIG. 6, the tool engagement portion 23 is made smaller in outer diameter than the conventional tool engagement portion 80 by forming the tool engagement portion 23 into an outer shape similar to that of the engaged part 58 with a predetermined dimension (thickness T) left outside the through hole 21 as in the case of the conventional metal shell. The diameter of the spark plug 10 can be decreased with reduction in the outer shape of the tool engagement portion 23. This contributes to a space saving in the internal combustion engine (not shown). Further, the corners of the tool engagement portion 23 are made smaller in thickness than those of the conventional tool engagement portion 80 so that the weight and material cost of the metal shell 20 can be decreased with such reduction in thickness.

Figure 7:
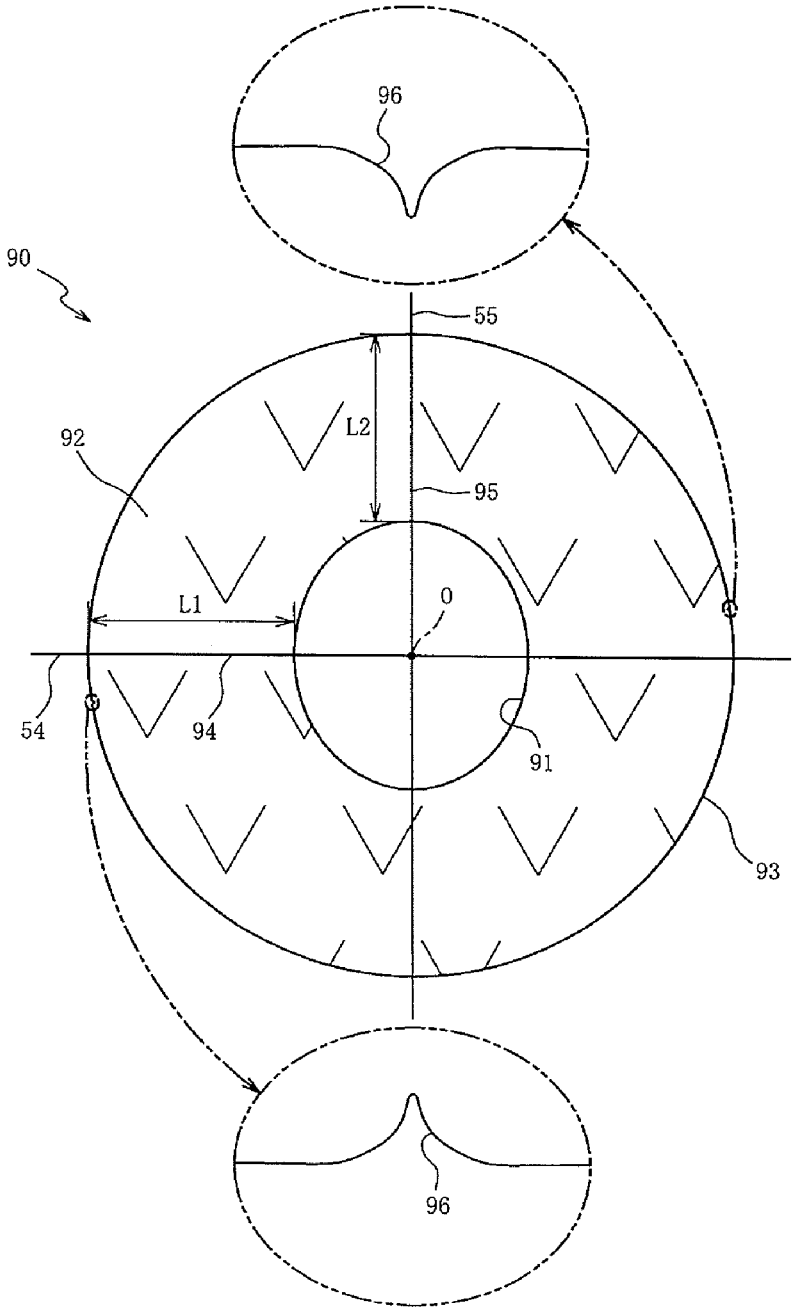
FIG. 7 is a cross-sectional view of a front end portion of an insulator of a spark plug according to a second embodiment of the present invention.

Next, a spark plug according to the second embodiment of the present invention will be explained below with reference to FIG. 7. The first embodiment refers to the case where the circular cross-section axial hole 41 is formed in the oval cross-section front end portion 45. By contrast, the second embodiment refers to the case where an oval cross-section axial hole 91 is formed in a circular cross-section front end portion 92 of an insulator. In the second embodiment, like parts and portions to those of the first embodiment are designated by like reference numerals to omit detailed explanations thereof. FIG. 7 is a cross-sectional view of the front end portion 92 of the insulator 90 of the spark plug according to the second embodiment of the present invention.

When viewed in cross section perpendicular to the axis O, the front end portion 92 is circular in outer shape; and the axial hole 91 is oval in shape as shown in FIG. 7. In place of the insulator 40 of the spark plug 10 explained in the first embodiment, the insulator 90 is held in the metal shell 20. In the present second embodiment, the first imaginary straight line 54 overlaps a shorter axis of the axial hole 91; and the second imaginary straight line 55 overlaps a longer axis of the axial hole 91. The positions of the first and second imaginary straight lines 54 and 55 are however not limited to these positions and can be set as appropriate within the range that satisfies L1>L2.

A length L1 of a first region 94 of the front end portion 92 overlapping the first imaginary straight line 54 is set greater than a length L2 of a second region 95 of the front end portion 92 overlapping the second imaginary straight line 55. An outer circumferential surface 93 of the front end portion 92 has an arithmetic average roughness Ra of 0.5 μm or smaller in a circumferential direction. A recess 96 is formed in the outer circumferential surface 93 of the front end portion 92 within the range of ±15° from the first region 94. More specifically, two recesses 96 are formed in the outer circumferential surface 93 of the front end portion 92 at positions apart from each other in the circumferential direction in the present second embodiment. These recesses 96 are equally spaced from each other in the circumferential direction.

As two recesses 96 are formed at circumferentially spaced positions, there are defined a plurality of conductive paths by carbon deposited in the recesses 96. As compared to the case of a single conductive path, it is possible by such a plurality of conductive paths to more easily generate a discharge for burning away of carbon deposits and thereby obtain an improvement in fouling resistance. Furthermore, the recesses 96 are circumferentially equally spaced apart from each other, that is, arranged in all directions in a state that the spark plug is mounted to the internal combustion engine (not shown). In this arrangement, variations in fouling resistance are prevented from occurring depending on the orientation of the insulator 90 on the internal combustion engine.

Examples

The present invention will be described in more detail below by way of the following examples. It should be noted that the following explanations are illustrative and are not intended to limit the present invention thereto.

Test samples of the spark plug 10 with various types of insulator 40 were produced as samples No. 1 to 30 and tested for their fouling resistance and withstand voltage. The samples No. 1 to 30 were varied by changing the arithmetic average roughness (Ra) of the outer circumferential surface 45*b* of the front end portion 45 of the insulator 40, the depth D of the recess 53, the width W of the recess 53, the number of the recesses 53 formed, the value of the length L2 of the second region 57 being divided by the length L1 of the first region 56 (as a length ratio) and the position (angle) of the recess 53 relative to the first region 56. In all of the samples No. 1 to 30, the length L of the recess 53 was set to 15 mm. In some samples where a plurality of recesses 53 were formed, the recesses 53 were circumferentially equally spaced apart from each other.

The fouling resistance was evaluated according to the smoldering fouling test procedure as defined in JIS D 1606 (1987). More specifically, a test vehicle with a four-cylinder 1500-cc engine was placed on a chassis dynamometer in a low-temperature test room (−10° C.). The spark plug samples were mounted to the respective cylinders of the engine of the test vehicle. The fouling resistance evaluation was made using four samples for each type of the spark plug 10.

The engine of the test vehicle to which the spark plug samples had been mounted was started and, after three idling motions, operated at 35 km/h in third gear for 40 seconds, at idling for 90 seconds and then at 35 km/h in third gear for 40 seconds. The engine was stopped and cooled. The engine was restarted and, after three idling motions, operated three times in total at 15 km/h in first gear for 20 seconds with engine stop intervals of 30 seconds. After that, the engine was stopped. A plurality of test cycles was carried out assuming the above series of operations as one test cycle.

After the completion of the test cycles, the four samples were detached from the test vehicle. The detached samples were set in a pressure chamber. Then, the occurrence or non-occurrence of a normal discharge between the center electrode 60 and the center electrode 30 (i.e. a discharge between the tips 32 and 65) of each sample was examined with the application of a voltage between the metal terminal 70 and the metal shell 20. The fouling resistance was evaluated as: "A" when the normal discharge occurred in all of the four samples; "B" when the normal discharge occurred in two or three out of the four samples; "C" when the normal discharge occurred in one out of the four samples; and "D" when the normal discharge did not occur in any one of the four samples.

The withstand voltage evaluation was made on the insulator 40 before the assembling of the insulator 40 into the spark plug 10. In a state that the insulator 40 was placed in a vertical position with the front end portion 45 directed downward, the protruding portion 42 was supported on an insulating member (not shown). A rod-shaped first electrode (not shown) was inserted in the axial hole 41. A ring-shaped second electrode (not shown) was disposed around the front end portion 45. Then, the insulator 40 and the first and second electrodes were immersed in an oil bath (not shown) filled with an insulating oil. The insulating oil used was Fluorinert (trademark) FC-43 available from 3M Company.

In this state, the breakdown voltage of each sample was measured with the application of a voltage between the first and second electrodes. The withstand voltage was evaluated as: "A" when the measured breakdown voltage was higher than or equal to 50 kV/mm; "B" when the measured breakdown voltage was higher than or equal to 45 kV/mm and lower than 50 kV/mm; "C" when the measured breakdown voltage was higher than or equal to 40 kV/mm and lower than 45 kV/mm; and "D" when the measured breakdown voltage was lower than 40 kV/mm.

TABLE 1

| | | | | | | | Evaluation results | |
|---|---|---|---|---|---|---|---|---|
| No. | Ra (μm) | Depth (μm) | Width (μm) | Recess (number) | Length ratio (—) | Angle (deg.) | Fouling resistance | Withstand voltage |
| 1 | 0.1 | 3 | 100 | 1 | 1.00 | — | C | A |
| 2 | 0.1 | 4 | 100 | 1 | 1.00 | — | C | A |
| 3 | 0.1 | 5 | 100 | 1 | 1.00 | — | B | A |
| 4 | 0.1 | 6 | 3 | 1 | 1.00 | — | B | A |
| 5 | 0.1 | 6 | 10 | 1 | 1.00 | — | B | A |
| 6 | 0.1 | 6 | 50 | 1 | 1.00 | — | B | A |
| 7 | 0.1 | 6 | 100 | 1 | 1.00 | — | B | A |
| 8 | 0.1 | 6 | 150 | 1 | 1.00 | — | B | A |
| 9 | 0.1 | 6 | 200 | 1 | 1.00 | — | B | A |
| 10 | 0.4 | 6 | 100 | 1 | 1.00 | — | B | A |
| 11 | 0.5 | 6 | 100 | 1 | 1.00 | — | B | A |
| 12 | 0.1 | 10 | 100 | 1 | 1.00 | — | B | A |
| 13 | 0.1 | 11 | 100 | 1 | 1.00 | — | C | A |
| 14 | 0.1 | 20 | 100 | 1 | 1.00 | — | C | A |
| 15 | 0.1 | 6 | 100 | 4 | 1.00 | — | A | A |
| 16 | 0.1 | 6 | 100 | 8 | 1.00 | — | A | A |
| 17 | 0.1 | 6 | 100 | 1 | 0.97 | 0 | B | A |
| 18 | 0.1 | 6 | 100 | 1 | 0.96 | 0 | B | A |
| 19 | 0.1 | 6 | 100 | 1 | 0.70 | 0 | B | A |
| 20 | 0.1 | 6 | 100 | 1 | 0.70 | 15 | B | B |
| 21 | 0.1 | 6 | 100 | 1 | 0.70 | 20 | B | C |
| 22 | 0.1 | 6 | 100 | 1 | 0.69 | 0 | B | C |
| 23 | 0.1 | 6 | 100 | 10 | 1.00 | — | C | A |
| 24 | 0.1 | 6 | 1 | 1 | 1.00 | — | C | A |
| 25 | 0.1 | 6 | 250 | 1 | 1.00 | — | C | A |
| 26 | 0.1 | 2 | 100 | 1 | 1.00 | — | D | A |
| 27 | 0.1 | 30 | 100 | 1 | 1.00 | — | C | D |
| 28 | 0.6 | 6 | 100 | 1 | 1.00 | — | D | A |

TABLE 1-continued

| No. | Ra (μm) | Depth (μm) | Width (μm) | Recess (number) | Length ratio (—) | Angle (deg.) | Evaluation results: Fouling resistance | Evaluation results: Withstand voltage |
|---|---|---|---|---|---|---|---|---|
| 29 | 2.0 | 6 | 100 | 1 | 1.00 | — | D | A |
| 30 | 0.1 | — | — | 0 | 1.00 | — | D | A |

As shown in TABLE 1, the fouling resistance and withstand voltage evaluation results of the samples No. 1 to 25 each of which satisfied the conditions that: the arithmetic average roughness (Ra) was 0.5 μm or smaller; and the depth of the recess was 3 to 20 μm were any of "A" to "C". However, the fouling resistance or withstand voltage evaluation results of the samples No. 26 to 30 each of which did not satisfy the above roughness and depth conditions were "D". It is apparent from these results that it is possible to not only ensure fouling resistance with deposition of carbon in the recess but also ensure withstand voltage performance by satisfaction of the conditions that: the arithmetic average roughness (Ra) is 0.5 μm or smaller; and the depth of the recess is 3 to 20 μm.

Attention is now focused on the samples No. 1 to 23. The fouling resistance evaluation results of the samples No. 3 to 12 and 15 to 23 in which the depth of the recess was 5 to 10 μm were "A" or "B". By contrast, the fouling resistance evaluation results of the samples No. 1, 2, 13 and 14 each of which did not satisfy the above depth condition were C. As is apparent from these results, an improvement in fouling resistance is obtained by satisfaction of the condition that the depth of the recess is 5 to 10 μm.

Attention is next focused on the samples No. 3 to 12 and 15 to 25. The fouling resistance evaluation results of the samples No. 3 to 12 and 15 to 23 in which the width of the recess was 3 to 200 μm were "A" or "B". By contrast, the fouling resistance evaluation results of the samples No. 24 and 25 each of which did not satisfy the above width condition were "C". As is apparent from these results, an improvement in fouling resistance is obtained by satisfaction of the condition that the width of the recess is 3 to 200 μm.

Further, attention is focused on the samples No. 3 to 12 and 15 to 23. The fouling resistance evaluation results of the samples No. 15 and 16 in which four or eight recess were formed were "A". By contrast, the fouling resistance evaluation results of the samples No. 3 to 12 and 17 to 22 in which one recess was formed were "B". The fouling resistance evaluation result of the sample No. 23 in which ten recesses were formed was "C". As is apparent from these results, an improvement in fouling resistance is obtained by the formation of a plurality of recesses (eight recesses at the maximum).

The samples No. 17 to 22 were different in the length L1 of the first region and the length L2 of the second region. The fouling resistance evaluation results of all of the samples No. 17 to 22 were "B". On the other hand, the withstand voltage evaluation results of the samples No. 17 to 19 were "A"; the withstand voltage evaluation result of the sample No. 20 was "B"; and the withstand voltage evaluation results of the samples No. 21 and 22 were "C". It is apparent from these results that, when the length L1 of the first region and the length L2 of the second region are set to different values, it is preferable to satisfy L2/L1>0.70 for improved withstand voltage performance. It is also apparent that, when the length L1 of the first region and the length L2 of the second region are set to different values, it is preferable to locate the recess within the range of 15° from the first region for improved withstand voltage performance.

Although the present invention has been described with reference to the above specific embodiments, the present invention is not limited to these specific embodiments. It is readily understood that various changes and modifications of the embodiments described above can be made within the range that does not depart from the scope and spirit of the invention. For example, the above-mentioned shape and size of the insulator 40, 90 is merely one example and can be set as appropriate.

In the above embodiments, the small-diameter portion 63 is provided on the front end part of the center electrode 60 so as to leave the air gap between the small-diameter portion 63 and the axial hole 41, 91 of the insulator 40, 90. With the utilization of such an air gap, a discharge is generated between the stepwise edge of the small-diameter portion 63 and the carbon deposited in the recess 53, 96 (conductive path) so that the carbon deposits can be burned away by the discharge. The spark plug is however not limited to such a configuration. In place of the small-diameter portion 63, a known auxiliary electrode may be provided in electrical connection with the metal shell 20. In this case, a discharge is generated between the carbon deposited in the recess 53, 96 and the auxiliary electrode so that carbon deposits can be burned away by the discharge The small-diameter portion 63 and the auxiliary electrode are not necessarily provided. Even when the small-diameter portion 63 or the auxiliary electrode is not provided, it is feasible to appropriate adopt a known technique of burning away carbon deposits by generating a discharge in an air gap between the carbon deposited in the recess 53, 96 (conductive path) or the center electrode 60 and the metal shell 20.

Further, it is feasible to prevent charging of the front end portion 45, 92 with the utilization of the carbon deposited in the recess 53, 96 (conductive path). By preventing charging of the front end portion 45, 92, carbon is made less likely to be deposited on the front end portion 45, 92. As a consequence, the deposition of carbon on the front end portion 45, 92 can be prevented to suppress a decrease in the insulation resistance of the front end portion 45, 92.

The length of the front end portion 45, 92 may be set longer such that heat generated by combustion of an air-fuel mixture accumulates in the front end portion 45, 92 to burn away the carbon deposited in the recess 53, 96. By burning away the carbon deposited in the recess 53, 96, the deposition of carbon on the front end portion 45, 92 can be prevented to suppress a decrease in the insulation resistance of the front end portion 45, 92.

In the above embodiments, the spark plug 10 has a structure in which the ground electrode 30 is joined to the front end of the metal shell 20 so as to protrude in the direction of the axis O. The spark plug 10 is however not limited to such a configuration. The insulators 40, 90 of the above embodiments are applicable to spark plugs (called "creeping discharge plugs") in which a ground electrode is arranged surrounding a center electrode 60, spark plugs (called "multi-polar discharge plugs") in which a plurality of ground electrodes are provided, and the like.

In the above first embodiment, the front end portion 45 is oval in cross section; and the axial hole 41 is circular in cross section. In the above second embodiment, the front end portion 92 is circular in cross section; and the axial hole 91 is oval in cross section. The insulator is however not limited to such a configuration. The shape of the front end portion or the axial hole may be changed from oval to elongated circular shape or squared circular shape because, even in this case, the front end portion is provided with the first and second regions of different wall thicknesses.

In the above embodiments, the first region 56, 94 and the second region 57, 95 are provided with different wall thickness on the front end portion 45, 92 of the insulator 40, 90. The insulator is however not limited to such a configuration. The insulator may have a circular cross-section front end portion formed with a circular cross-section axial hole (that is, the front end portion has a wall thickness substantially uniform throughout its entire circumference). Regardless of the cross-sectional shape of the front end portion, carbon deposits on the front end portion can be burned away with the utilization of one or a plurality of recesses formed in the outer circumferential surface of the front end portion.

Although one or two recesses 53, 96 are formed in the front end portion 45, 92 of the insulator 40, 90 in the above embodiments, the insulator 40, 90 is not limited to such a configuration. The number of recesses formed can be set as appropriate. Preferably, the number of recesses formed is two to eight. When the number of recesses formed is nine or more, there are provided a large number of conductive paths by the carbon deposited in the recess. In this case, weak discharges frequently occur between the conductive paths and the electrode so that it tends to become difficult to burn away carbon deposits.

In the above embodiments, the tool engagement portion 23 is hexagonal in outer shape. The tool engagement portion is however not limited to such a configuration. The outer shape of the tool engagement portion 23 can be set as appropriate as long as the tool engagement portion 23 has a face or faces, preferably two faces parallel to the axis O, engageable with the tool such as wrench.

Further, the engaged part 58 of the metal shell 20 is hexagonal in shape in the above embodiments. The engaged part is however not limited to such a configuration. It is feasible to decrease the wall thickness of the tool engagement portion 23 when the shape of the engaged part 58 is similar to the shape of the tool engagement portion 23 as viewed in cross section perpendicular to the axis O. Hence, the shape of the engaged part 58 can be set as appropriate according to the shape of the tool engagement portion 23.

Furthermore, the hexagonal engaging part 42*a* is formed on the protruding portion 42 of the insulator 40, 90 in the above embodiments. The engaging part 42*a* is however not limited to such a configuration. The engaging part 42*a* is a part for positioning the insulator 40 relative to the metal shell 20 in the circumferential direction by circumferential engagement of the engaging part with the engaged part 58 of the metal shell. Depending on the shape of the shape of the engaged part 58, the shape of the engaging part can be set as appropriate so as to engage with the inner side of the engaged part unrotatably about the axis O.

Although the mark 42*b* is formed on the protruding portion 42 of the insulator 40, 90 by chamfering one ridge of the protruding portion in the above embodiments, the mark 42*b* is not limited to such a configuration. The shape and position of the mark 42*b* can be set arbitrarily. Similarly, the shape of the position of the mark 59 on the metal shell 20 can be set arbitrarily in correspondence with the mark 42*b*.

In the above embodiments, the tips 32 and 65 are respectively provided to the ground electrode 30 and the center electrode 60. The electrode 30, 60 is however not limited to such a configuration. The tip 32, 65 may naturally be omitted.

Although the resistor 71 is built in the insulator 40, 90 of the spark plug 10 in the above embodiment, the spark plug is not limited to such a configuration. The above embodiments are applicable to the manufacturing of spark plugs with no built-in resistors. In this case, the center electrode 60 and the metal terminal 70 are connected via the conductive seal 72 by omission of the resistor 71 and the conductive seal 73.

DESCRIPTION OF REFERENCE NUMERALS

10: Spark plug
20: Metal shell
27: Shelf portion
30: Ground electrode
40, 90: Insulator
41, 91: Axial hole
42: Protruding portion
42*a*: Engaging part
45, 92: Front end portion
45*a*: End surface
45*b*, 93: Outer circumferential surface
46: Step portion
53, 96: Recess
54: First imaginary straight line
55: Second imaginary straight line
56, 94: First region
57, 95: Second region
58: Engaged part
60: Center electrode
D: Depth
L: Length
W: Width
O: Axis Having described the invention, the following is claimed:

1. A spark plug comprising:

a center electrode extending along an axis from front to rear;

a cylindrical insulator having formed therein along the axis an axial hole in which the center electrode is arranged, the insulator including a step portion formed on an outer circumferential surface thereof and having a diameter increasing from a front end side to a rear end side;

a cylindrical metal shell arranged radially outside the insulator, the metal shell including a shelf portion formed on an inner circumferential surface thereof and facing the step portion in a direction of the axis; and a ground electrode joined to the metal shell and facing the center electrode, wherein the insulator includes a front end portion located frontward of the step portion, wherein an outer circumferential surface of the front end portion has an arithmetic average roughness of 0.5 μm or smaller in a circumferential direction, and wherein a recess is formed with a depth of 3 to 20 μm in at least a part of an end surface and the outer circumferential surface of the insulator so as to extend from the front toward the rear.

2. The spark plug according to claim 1, wherein the depth of the recess is 5 to 10 μm.

3. The spark plug according to claim 1, wherein a width of the recess in the circumferential direction is 3 to 200 μm.

4. The spark plug according to claim 1, wherein a length of the recess in the direction of the axis is 0.1 to 20 mm.

5. The spark plug according to claim 1, wherein two to eight recesses are formed in the front end portion at positions apart from each other in the circumferential direction.

6. The spark plug according to claim 5, wherein the recesses are equally spaced apart from each other in the circumferential direction.

7. The spark plug according to claim 1, wherein, in a cross section perpendicular to the axis, assuming a first imaginary straight line passing through the axis and a second imaginary straight line passing through the axis and intersecting the first imaginary straight line at a right angle, a first region of the front end portion overlapping the first imaginary straight line is greater in length than a second region of the front end portion overlapping the second imaginary straight line, and the recess is located in the front end portion within a range of ±15° from the first region.

8. The spark plug according to claim 7, wherein a value of the length of the second region being divided by the length of the first region is in a range of 0.7 to 0.96.

9. The spark plug according to claim 1, wherein, when viewed in the direction of the axis, the recess is located at a side opposite from the ground electrode with the center electrode interposed therebetween.

10. The spark plug according to claim 1, wherein the insulator includes a protruding portion protruding radially outwardly from the outer circumferential surface thereof at a position rearward of the step portion, wherein the metal shall has an engaged part formed on the inner circumferential surface thereof at a position rearward of the step portion, and wherein the protruding portion has an engaging part that engages with the engaged part in the circumferential direction.

* * * * *